US006269779B2

(12) United States Patent
Overbey, Jr.

(10) Patent No.: US 6,269,779 B2
(45) **Date of Patent: *Aug. 7, 2001**

(54) SEALED ACCESS ASSEMBLY FOR WATER HEATERS

(75) Inventor: Fred A. Overbey, Jr., Bristol, TN (US)

(73) Assignee: SRP 687 Pty Ltd. (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/137,344

(22) Filed: Aug. 21, 1998

(51) Int. Cl.[7] ..... F22B 5/00

(52) U.S. Cl. ..... 122/13.01; 122/14.21; 122/19.2; 122/494; 122/504

(58) Field of Search ..... 122/19.2, 13.01, 122/14.21, 17.1, 494, 504; 126/39 E, 344; 431/278, 285, 154, 159, 264, 343

(56) References Cited

U.S. PATENT DOCUMENTS

| | | | | |
|---|---|---|---|---|
| 0,736,153 | | 8/1903 | Reynolds . | |
| 1,806,216 | | 5/1931 | Plummer . | |
| 1,841,463 | | 1/1932 | Barber et al. . | |
| 2,070,535 | * | 2/1937 | Hansen | 126/350 R |
| 2,479,042 | | 8/1949 | Gaines . | |
| 3,161,227 | | 12/1964 | Goss et al. . | |
| 3,920,375 | | 11/1975 | Sanderson et al. . | |
| 3,947,229 | | 3/1976 | Richter . | |
| 4,039,272 | | 8/1977 | Elliot . | |
| 4,055,063 | * | 10/1977 | Krips et al. | 72/62 |
| 4,080,149 | | 3/1978 | Wolfe . | |
| 4,177,168 | | 12/1979 | Denny et al. . | |
| 4,204,833 | | 5/1980 | Kmetz et al. . | |
| 4,241,723 | | 12/1980 | Kitchen . | |
| 4,263,878 | * | 4/1981 | Hurley et al. | 122/136 C |
| 4,510,890 | | 4/1985 | Cowan . | |
| 4,519,770 | | 5/1985 | Kesselring et al. . | |
| 4,639,213 | | 1/1987 | Simpson . | |
| 4,823,770 | | 4/1989 | Loeffler . | |
| 4,863,370 | | 9/1989 | Yokoyama et al. . | |
| 4,869,232 | | 9/1989 | Narang . | |
| 4,893,609 | | 1/1990 | Giordani et al. . | |
| 4,919,085 | | 4/1990 | Ishiguro . | |

(List continued on next page.)

FOREIGN PATENT DOCUMENTS

| | | |
|---|---|---|
| 25 40 709 A 1 | 3/1977 | (DE) . |
| 2747024 A | 2/1979 | (DE) . |
| 39 26 699 A 1 | 2/1991 | (DE) . |

(List continued on next page.)

OTHER PUBLICATIONS

"Flame Traps—a Technical Note" Journal of Mines, Metals & Fuels, Jul. 1987.

*Primary Examiner*—Jiping Lu
(74) *Attorney, Agent, or Firm*—Schnader Harrison Segal & Lewis LLP

(57) ABSTRACT

A water heater including a water container; a combustion chamber containing a main burner and a pilot burner positioned to heat water in the water container and having a side wall; a main burner fuel supply line adapted to connect between a fuel control valve and a main burner; a pilot fuel supply line adapted to connect between the fuel control valve and a pilot burner; a heat sensor line connected to a heat sensor and adapted to connect to the fuel control valve and positioned to sense heat from the pilot burner; an igniter line connected to an igniter positioned proximate the pilot burner and connected to an igniter initiator; and a removable plate sealed to the combustion chamber through which the main burner fuel supply line, the pilot fuel supply line, the heat sensor line and the igniter line pass in a sealed condition.

28 Claims, 8 Drawing Sheets

U.S. PATENT DOCUMENTS

| | | | |
|---|---|---|---|
| 4,924,816 | | 5/1990 | Moore, Jr. et al. . |
| 4,960,078 | | 10/1990 | Yokoyama et al. . |
| 5,044,928 | | 9/1991 | Yokoyama et al. . |
| 5,085,205 | | 2/1992 | Hall et al. . |
| 5,205,731 | | 4/1993 | Reuther et al. . |
| 5,215,457 | | 6/1993 | Sebastiani . |
| 5,240,411 | | 8/1993 | Abalos . |
| 5,246,397 | | 9/1993 | Petter . |
| 5,317,992 | | 6/1994 | Joyce . |
| 5,355,841 | | 10/1994 | Moore, Jr. et al. . |
| 5,368,263 | | 11/1994 | Harrison . |
| 5,385,467 | | 1/1995 | Sebastiani et al. . |
| 5,397,233 | | 3/1995 | Eavenson et al. . |
| 5,413,790 | * | 5/1995 | Koppe et al. ..... 424/411 |
| 5,427,525 | | 6/1995 | Shukla et al. . |
| 5,435,716 | | 7/1995 | Joyce . |
| 5,448,969 | | 9/1995 | Stuart et al. . |
| 5,494,003 | | 2/1996 | Bartz et al. . |
| 5,520,536 | | 5/1996 | Rodgers et al. . |
| 5,522,723 | | 6/1996 | Durst et al. . |
| 5,531,214 | | 7/1996 | Cheek . |
| 5,575,274 | | 11/1996 | DePalma . |
| 5,588,822 | | 12/1996 | Hayakawa et al. . |
| 5,649,821 | | 7/1997 | Fogliani et al. . |
| 5,674,065 | | 10/1997 | Grando et al. . |
| 5,791,298 | | 8/1998 | Rodgers . |
| 5,797,358 | | 8/1998 | Brandt et al. . |

FOREIGN PATENT DOCUMENTS

| | | |
|---|---|---|
| 462296 A | 12/1991 | (EP) . |
| 0 560 419 A2 | 9/1993 | (EP) . |
| 0 596 555 A1 | 5/1994 | (EP) . |
| 0 657 691 A1 | 6/1995 | (EP) . |
| 2566101 A | 12/1985 | (FR) . |
| 60-134117 | 7/1985 | (JP) . |
| 62-162814 | 7/1987 | (JP) . |
| WO 94/01722 | 1/1994 | (WO) . |

* cited by examiner

SEALED ACCESS ASSEMBLY FOR WATER HEATERS

FIELD OF INVENTION

The present invention relates to gas fired water heaters, particularly to gas fired water heaters that have sealed access components.

BACKGROUND OF INVENTION

The most commonly used gas-fired water heater is the storage type, generally comprising an assembly of a water tank, a main gas burner to provide heat to the tank, a standing pilot burner to initiate the main burner on demand, an air inlet adjacent the burner near the base of the jacket, an exhaust flue and a jacket to cover these components. Another type of gas-fired water heater is the instantaneous type which has a water flow path through a heat exchanger heated, again, by a main burner initiated from a pilot burner flame.

For convenience, the following description is in terms of storage type water heaters but the present invention is not limited to this type. Thus, reference to "water container," "water containment and flow means," "means for storing or containing water" and similar such terms includes water tanks, reservoirs, bladders, bags and the like in gas-fired water heaters of the storage type and water flow paths such as pipes, tubes, conduits, heat exchangers and the like in gas-fired water heaters of the instantaneous type.

A particular difficulty with many locations for water heaters is that they are also used for storage of other equipment such as lawn mowers, trimmers, snow blowers and the like. It is a common procedure for such machinery to be refueled in such locations. There have been a number of reported instances of spilled gasoline and associated fumes being accidently ignited. There are many available ignition sources, such as refrigerators, running engines, electric motors, electric light switches and the like. However, gas water heaters have sometimes been suspected because they often have a pilot flame.

Vapors from spilled or escaping flammable liquid or gaseous substances in a space in which an ignition source is present, provide a potential for ignition. "Fumes," "extraneous gases" or "extraneous fumes" are sometimes hereinafter used to encompass gases, vapors or fumes generated by a wide variety of liquid volatile or semi-volatile substances such as gasoline, kerosene, turpentine, alcohols, insect repellent, weed killer, solvents and the like as well as non-liquid substances such as propane, methane, butane and the like.

In reconstructions of accidental ignition situations, and when gas water heaters are sometimes suspected and which involved spilled fuels typically used around households, it is reported that the spillage is sometimes at floor level and, it is reasoned, that it spreads outwardly from the spill at first close to floor level. Without appreciable forced mixing, the air/fuel mixture would tend to be at its most flammable levels close to floor level for a longer period before it would slowly diffuse towards the ceiling of the room space. The principal reason for this observation is that the density of fumes typically involved is not greatly dissimilar to that of air. Combined with the tendency of ignitable concentrations of the fumes being at or near floor level is the fact that many gas appliances often have their source of ignition at or near that level.

The present invention aims to substantially lower the probability of fumes entering the water heater at locations where fuel supply lines, detectors, igniters and the like enter the combustion chamber.

SUMMARY OF INVENTION

The invention provides an assembly for a water heater that includes a burner fuel supply line adapted to connect between the fuel control valve and the burner, a pilot fuel supply line adapted to connect between the fuel control valve and the pilot burner, a detection line containing a heat sensor adapted to connect to the fuel control valve and positioned to sense heat from the pilot burner, and a line having an igniter positioned proximate the pilot burner and connected to the igniter initiator. The burner fuel supply line, pilot fuel supply line, detection line and line having an igniter pass through a plate in a sealed condition. The plate is adapted to sealingly engage the side portion of the combustion chamber of the water heater.

The invention also provides a water heater that includes a water tank and a combustion chamber containing a main burner positioned to heat water in the water tank and a pilot burner. An assembly that extends into the combustion chamber includes a burner fuel supply line adapted to connect between the fuel control valve and the burner, a pilot fuel supply line adapted to connect between the fuel control valve and the pilot burner, a detection line containing a heat sensor adapted to connect to the fuel control valve and positioned to sense heat from the pilot burner; a line having an igniter positioned proximate the pilot burner and connected to the igniter initiator. The burner fuel supply line, pilot fuel supply line, detection line and line having an igniter pass through a removable plate in a sealed condition. The plate is adapted to sealingly engage a side portion of a combustion chamber of the water heater. Foam insulation surrounds the water tank to maintain thermal efficiency.

BRIEF DESCRIPTION OF THE DRAWINGS

An embodiment of the present invention will now be described, by way of example only, by reference to the accompanying drawings in which.

DETAILED DESCRIPTION OF THE DRAWINGS

Figure 1:
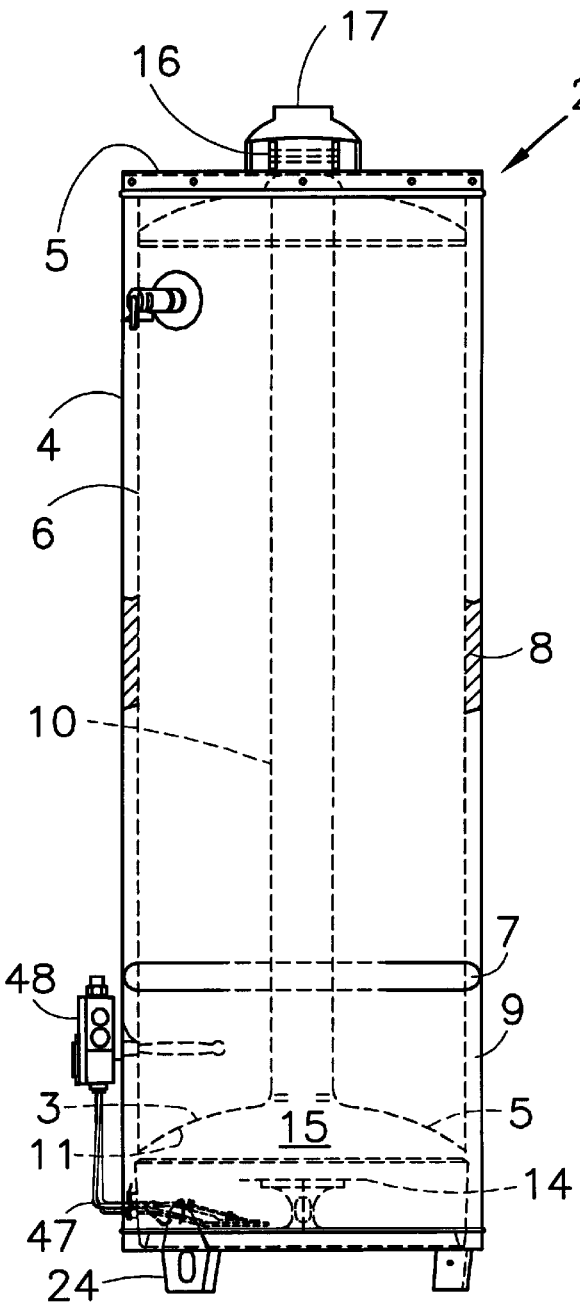
FIG. 1 is a front elevational view, taken partly in section, of a gas water heater embodying aspects of the invention.
Figure 2:
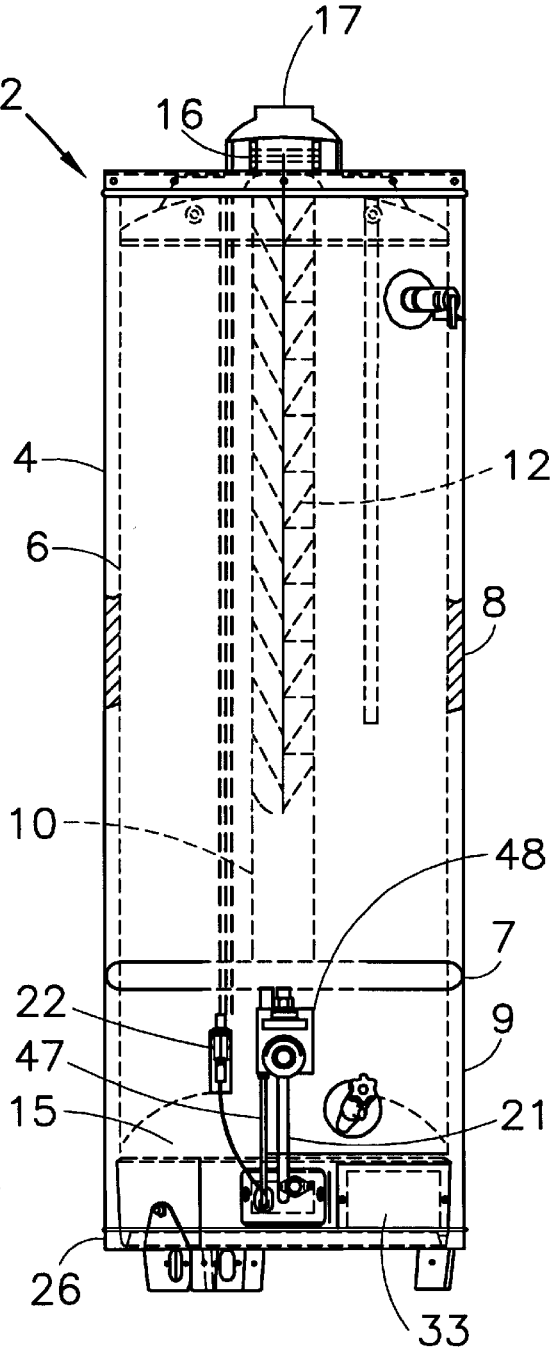
FIG. 2 is a side elevational view, taken partly in section, of the gas water heater shown in FIG. 1.

It will be appreciated that the following description is intended to refer to the specific embodiments of the invention selected for illustration in the drawings and is not intended to limit or define the invention, other than in the appended claims.

Turning now to the drawings in general and FIGS. 1–5 in particular, the number "2" designates a storage type gas water heater 2. Water heater 2 includes jacket 4 which surrounds a water tank 6, a main burner 14 in a combustion chamber 15. Passing through the center of the tank 6 is a flue 10, in this instance incorporating a series of baffles 12 to better transfer heat generated by the main burner 14. Water tank 6 is preferably of mains pressure capability and is capable of holding heated water. Water tank 6 is preferably insulated by foam insulation 8. Alternative insulation may include fiberglass or other types of fibrous insulation and the like. Fiberglass insulation 9 surrounds combustion chamber 15 and the lowermost portion of water tank 6. It is possible that heat resistant foam insulation can be used if desired. A foam dam 7 separates foamed insulation 8 and fiberglass insulation 9.

Located underneath the water tank 6 is the main burner 14 which uses natural gas or other gases such as LPG, for example. Other suitable fuels may be substituted. Main burner 14 combusts a gas and air mixture and the hot products of combustion resulting rise up through flue 10, possibly with heated air. Water tank 6 is lined with a glass coating for corrosion resistance. Bottom 5 of water tank 6 is preferably coated on both its interior facing surface 3 and exterior facing surface 11. The thickness of the coating of exterior facing surface 11 is about half of the thickness of interior facing surface 3. Also, the lower portion of flue 10 is preferably coated on both of its opposing surfaces. The surface exposed to the flue gases has a thickness about half the thickness of the surface exposed to water in water tank 6. It has been discovered that the glass coating helps to prevent scaling of the flue and water tank surfaces.

Combustion chamber 15 also contains a pilot burner 49 connected to gas control valve 48 by pilot fuel supply line 47. A sheath 52, preferably made of copper, containing wires (not shown) from a flame detecting thermocouple 51 to ensure that in the absence of a flame at pilot burner 49 gas control valve 48 shuts off the gas supply. Thermocouple 51 may be selected from those known in the art. RobertShaw Model No. TS 75OU is preferred. Gas control valve 48 supplies fuel to burner 14 by way of fuel supply line 21.

Figure 3:
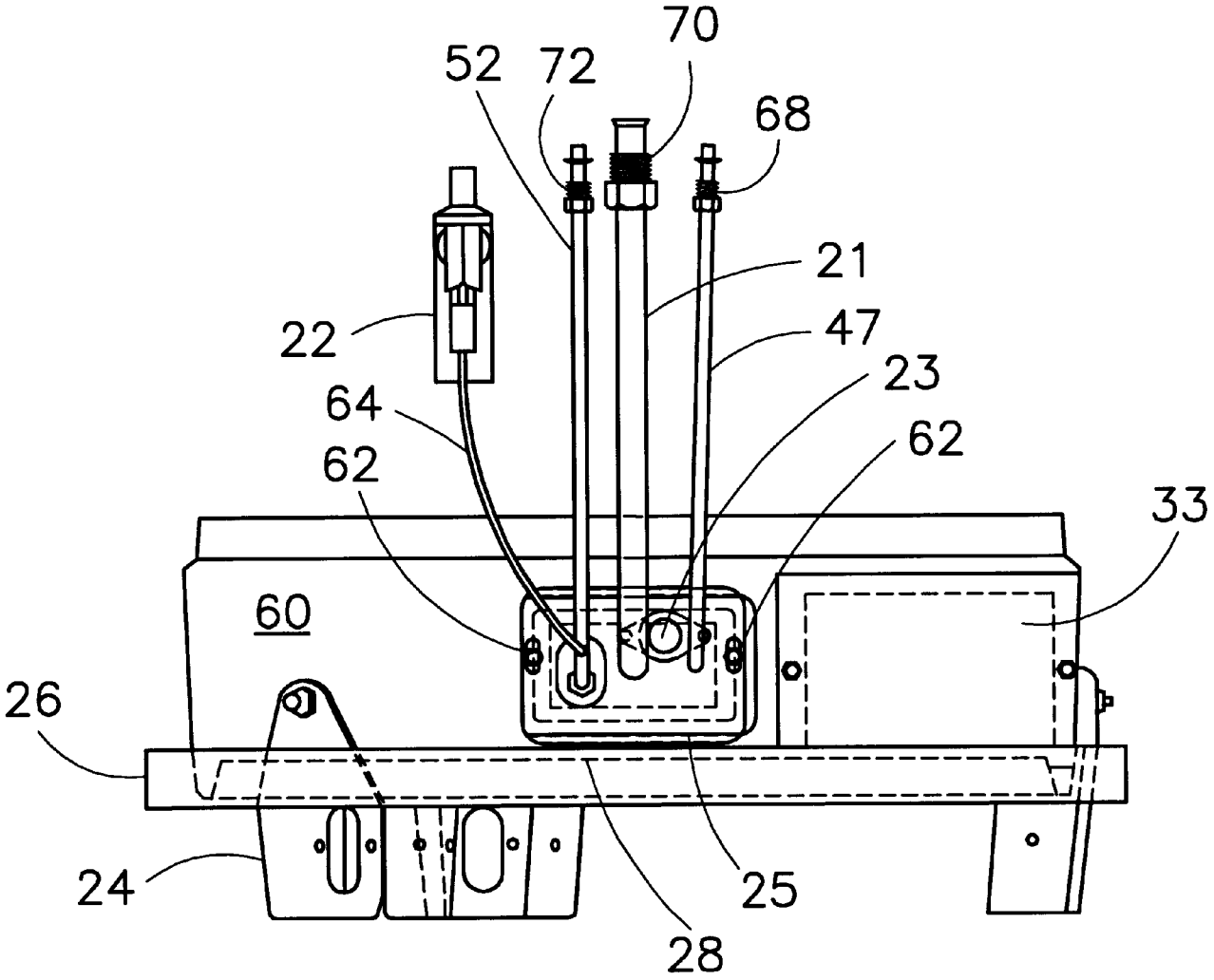
FIG. 3 is a front elevational view of selected parts of the lower portion of the gas water heater shown in FIG. 2.
Figure 5:
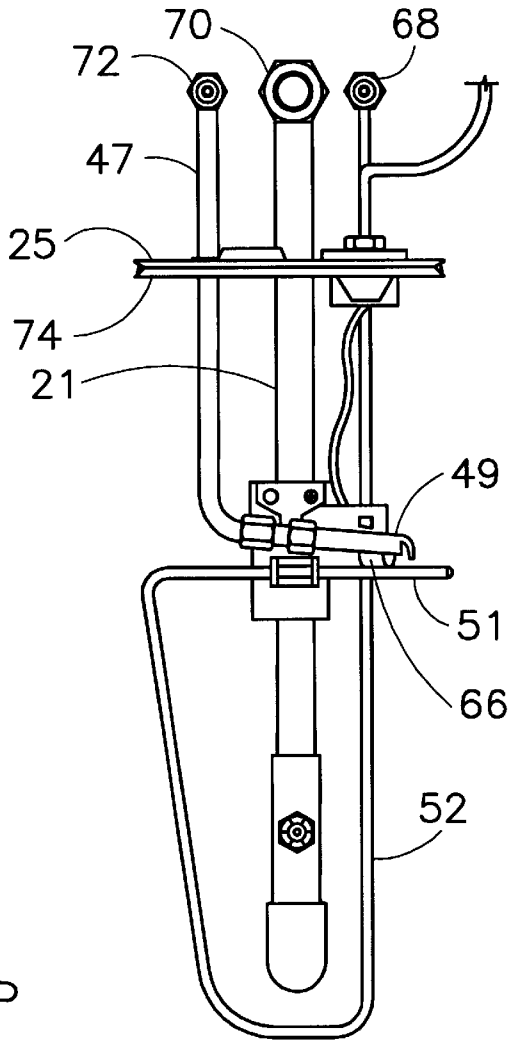
FIG. 5 is a top plan view of the assembly shown in FIG. 4.
Figure 4:
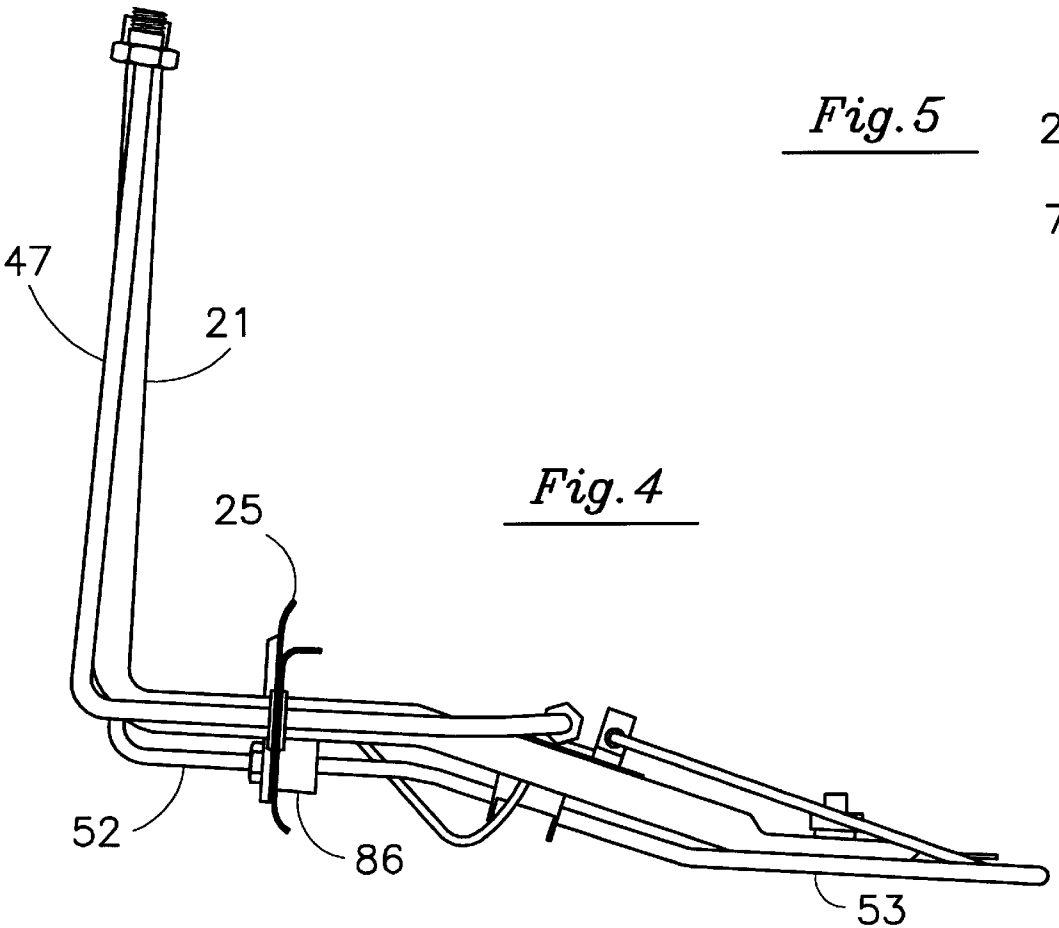
FIG. 4 is a side view of a fuel supply line assembly with the burner moved for ease of understanding.
Figure 7:
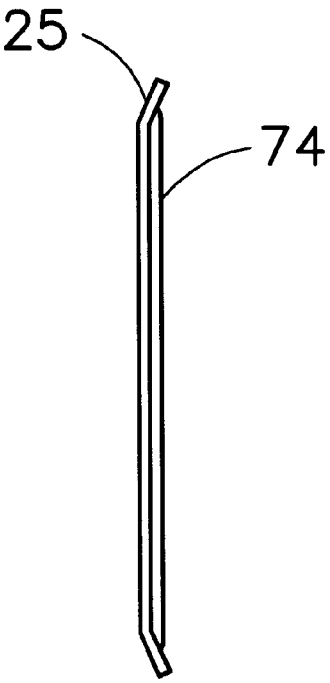
FIG. 7 is an exploded side view of the removable assembly plate shown in FIG. 6.

FIG. 3 particularly shows fuel supply line 21 and pilot fuel supply line 47 extending outwardly from a plate 25. Plate 25 is removably sealable to skirt 60 that forms the side wall of combustion chamber 15. Plate 55 is held into position by a pair of screws 62 or by any other suitable means. Of course, pilot fuel supply line 47 and fuel supply line 21 pass through plate 25 in a substantially fixed and sealed condition. Sheath 52 also extends through plate 25 in a substantially fixed and sealed condition as does igniter line 64. Igniter line 64 connects on one end to an igniter button 22 and a piezo igniter 66 (see FIG. 5). Igniter button 22 can be obtained from Channel Products, for example. Each of pilot fuel supply line 47, fuel supply line 21 and sheath 52 are removably connectable to gas control valve 48 by compression nuts 68, 70 and 72, respectively. Each of compression nut 68, 70 and 72 are threaded and threadingly engage control valve 48.

The products of combustion pass upwards and out the top of jacket 4 via flue outlet 16 after heat has been transferred from the products of combustion. The flue outlet 16 discharges conventionally into a draft diverter 17 which in turn connects to an exhaust duct leading outdoors.

Water heater 2 is preferably mounted on legs 24 to raise bottom pan 26 off the floor. Bottom pan 26 preferably has one or more apertures 28 or some other means (not shown) for receiving combustion air. Where bottom pan 26 meets jacket 4, the mating surfaces (made up from surfaces of bottom pan 26 and jacket 4) can be sealed thoroughly to prevent ingress of air or any flammable gas or vapor. The cylindrical wall of jacket 4 (the majority of gas water heaters are cylindrical; however, a cubic shaped jacket 4 may be utilized) can be sealed gas tightly so no openings or breaks remain upon assembly and installation.

In particular, gas, water, electrical, control, or other connections, fittings or plumbing, wherever they pass through the jacket 4 or base 26, can be sealed airtight. The joining area of bottom pan 26 to jacket 4 and all service entries or exits to the jacket 4 need not be sealed airtight. It is preferred, however, that the space around burner 14 be substantially air/gas tight except for means to supply combustion air.

As shown in FIGS. 3–7, plate 25 has a heat resistant gasket 74 adhered to its inner surface and is adapted to be positioned against the outer surface of skirt 60 to ensure that plate 25 is sealed to skirt 60.

Figure 6:
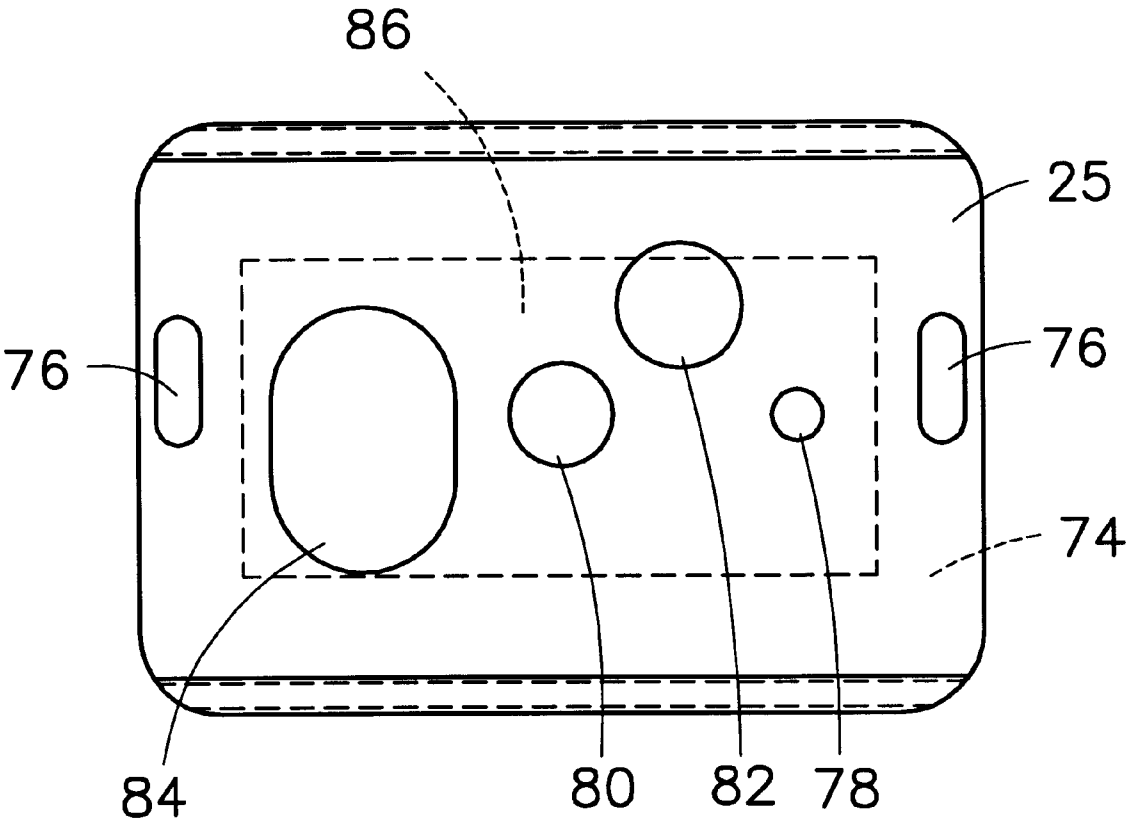
FIG. 6 is an exploded front elevational view of a removable assembly plate.

As particularly shown in FIG. 6, plate 25 has a series of openings or holes. Holes 76 are adapted to receive screws 62 to assist in the mounting and sealing of plate 25 against skirt 60. Opening 78 is sized and shaped to closely and sealingly receive pilot fuel supply line 47. Opening 80 is sized and shaped to closely and sealingly receive fuel supply line 21. Opening 82 is sized and shaped to sealingly receive window 23, which preferably snaps into place. Finally, opening 84 is sized and shaped to sealingly receive a plastic connector 86 that contains sheath 52 and igniter line 64.

Gasket 74 has an opening 86 that is sized essentially the same as a corresponding opening in skirt 60. Gasket 74 is preferably a fiberglass reinforced silicone sponge having a thickness of about 1/16". It resists temperatures of up to about 500° F. and is adhered to plate 25 with an acrylic material.

Figure 8:
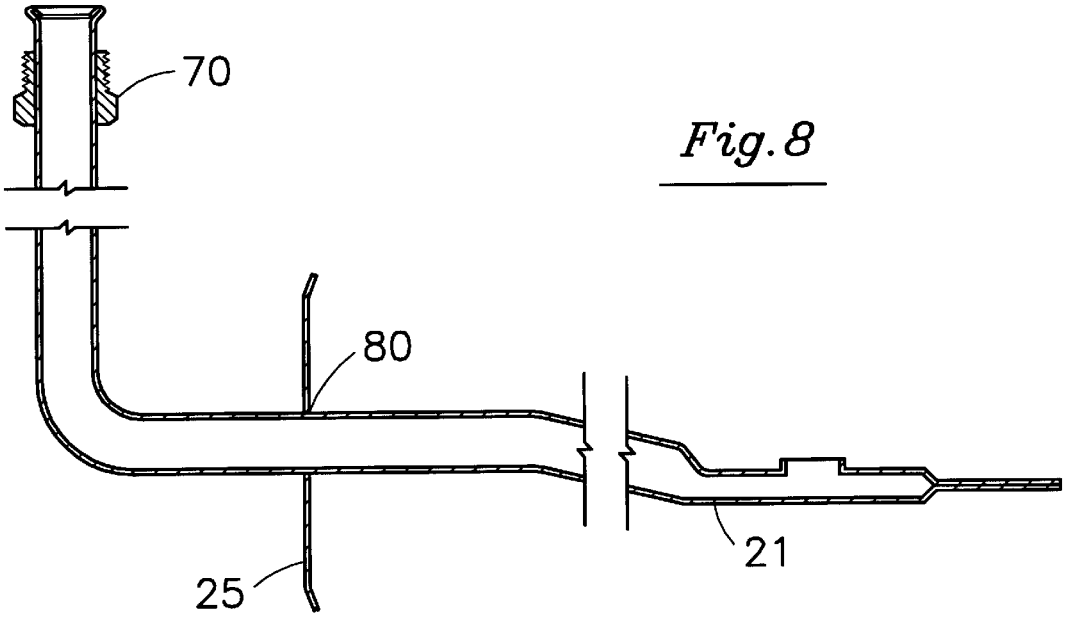
FIG. 8 is a side cross sectional view of a fuel supply line extending through the removable assembly plate shown in FIGS. 6 and 7 prior to swaging.
Figure 9:
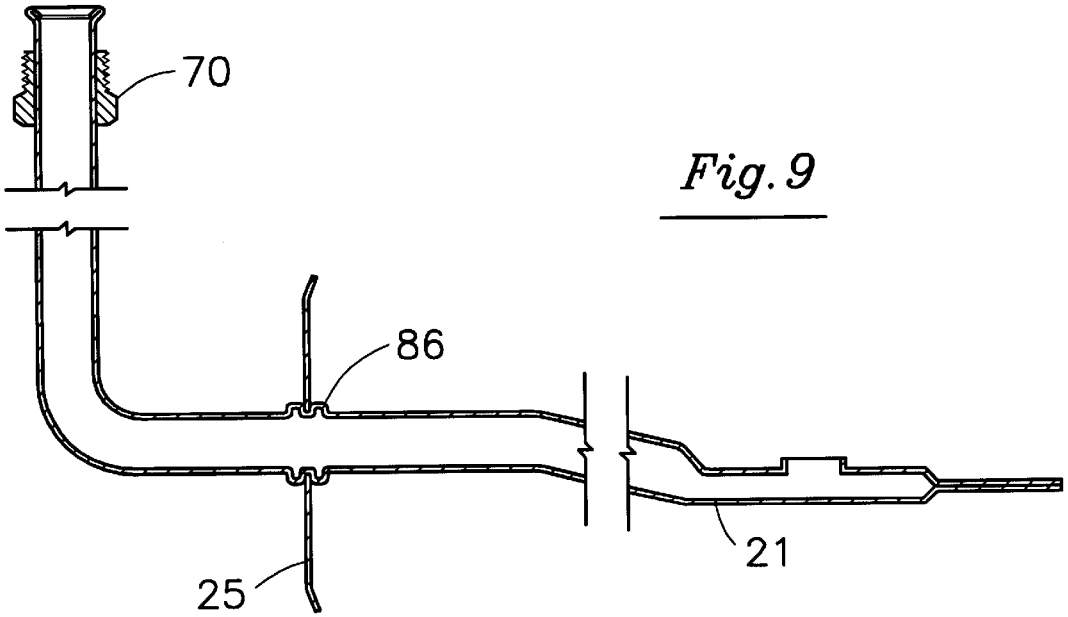
FIG. 9 is a side cross sectional view of the fuel supply line extending through the removable assembly plate shown in FIGS. 6 and 7 after swaging.

Reference to FIGS. 8 and 9 shows fuel supply line 21 in a condition prior to being sealed within plate 25 and in a post sealed condition, respectively. In FIG. 8, main fuel supply line 21 has been passed through opening 80 in plate 25 and is in position to be fixed into place and sealed with respect to plate 25. FIG. 9 shows main fuel supply line 21 in a fixed and sealed condition through opening 80 as shown by swage 86. Swaging is performed in a conventional manner wherein a die is formed around main fuel supply line 21 and squeezing force is applied to urge the portions of supply line 21 adjacent plate 25 on both its sides toward plate 25, thereby sealing those portions against the opposing surfaces of plate 25.

Figure 10:
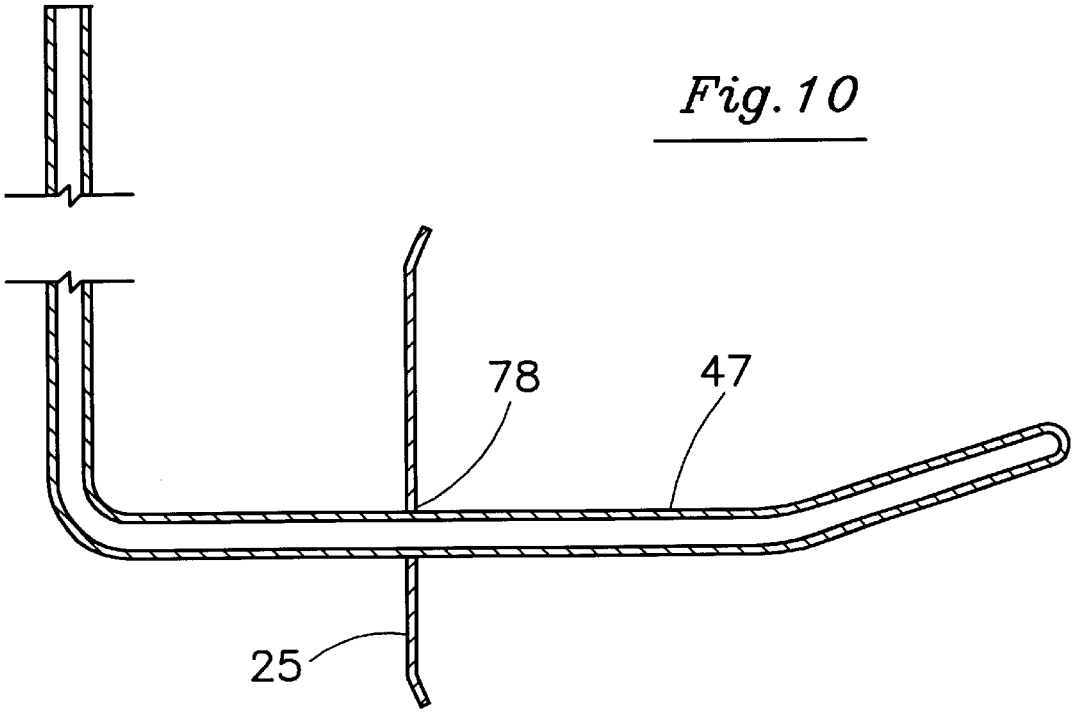
FIG. 10 is a side cross sectional view of a pilot fuel supply line extending through the removable assembly plate shown in FIGS. 6 and 7 prior to swaging.
Figure 11:
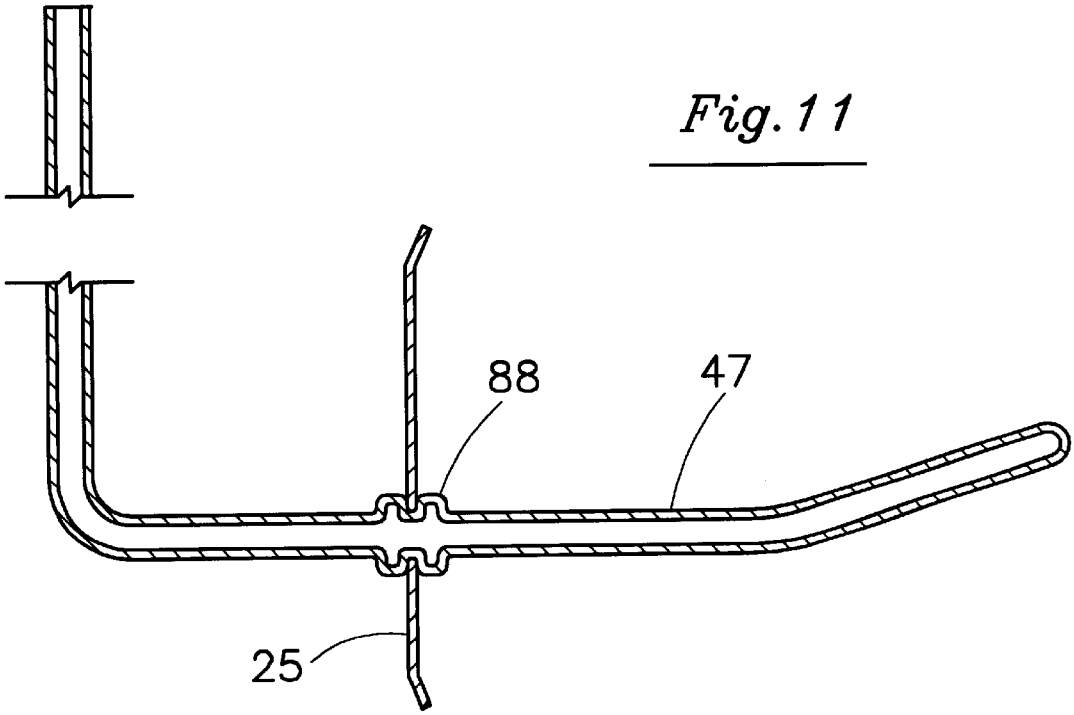
FIG. 11 is a side cross sectional view of the pilot fuel supply line extending through the removable assembly plate shown in FIGS. 6 and 7 after swaging.
Figure 13:
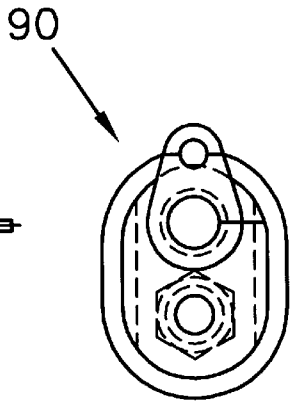
FIG. 13 is a front elevational view of the connector shown in FIG. 12 with an igniter line passing therethrough.

FIGS. 10 and 11 show the same pre- and post-swaging conditions for pilot supply line 47. As in the case of main fuel supply line 21, a swage 88 is located immediately adjacent opposed sides of plate 25, thereby fixing pilot fuel supply line 47 in place and sealing opening 78.

FIGS. 12–15 show a connector 90 that is sized and shaped to fill and seal opening 84 (see FIG. 6) in plate 25. Connector 90 should be made from a heat resistant material capable of resisting direct exposure to flames such as Plenco 4349 phenolic resin. Connector 90 includes a base member 92 and a flange 94 that extends radially outwardly therefrom. Connector 90 has an opening 96 that is sized and shaped to receive igniter line 64. Connector 90 also has an opening 98, a portion of which has a larger diameter. The larger portion of opening 98 is sized and shaped to receive compression nut 100. The narrow portion of opening 98 is sized and shaped to receive sheath 52. Similarly, compression nut 100 has an interior opening that is threaded and sized and shaped to receive ferrule nut 114. Compression nut 100 also has a seal seat 99 within its open interior. Ferrule nut 114 has exteriorly positioned threads to engage compression nut 100 and a seal surface 103. It also has an opening 101 through which sheath 52 passes in a substantially sealed condition. A compression ring 102 has an inner opening sized and shaped to receive sheath 52 and is designed to seal between cap nut 104 and compression nut 70 (see FIG. 3).

A cap nut 104 has a central opening that is sized and shaped to closely receive sheath 52 and has threads on a portion of its outer surface. Those threads engage the threads on the outer surface of compression nut 70. This causes compression ring 102 to sealingly engage compression nut 70 and seal sheath 52.

Figure 14:
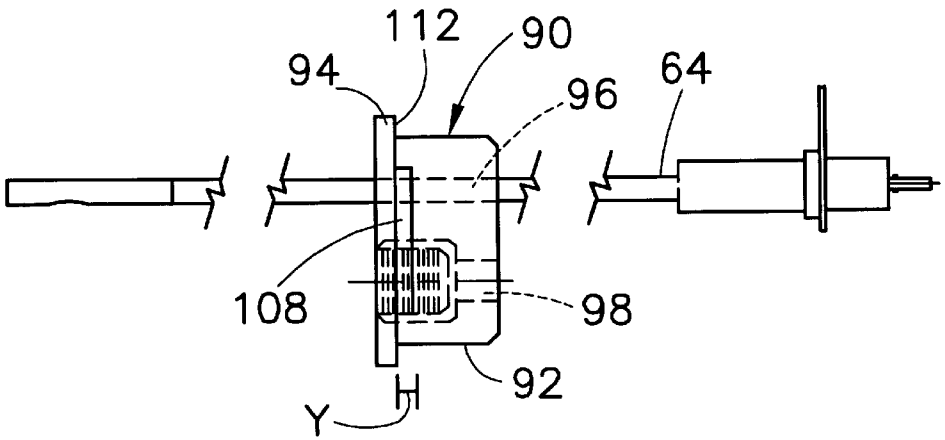
FIG. 14 shows a side elevational view of the connector shown in FIGS. 12 and 13 with an igniter line passing therethrough.
Figure 17:
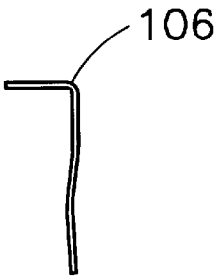
FIG. 17 shows a side elevational view of the connector bracket shown in FIG. 15.
Figure 16:
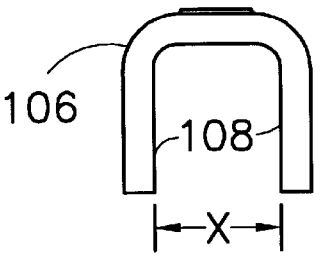
FIG. 16 shows a front elevational view of a connector bracket.
Figure 12:
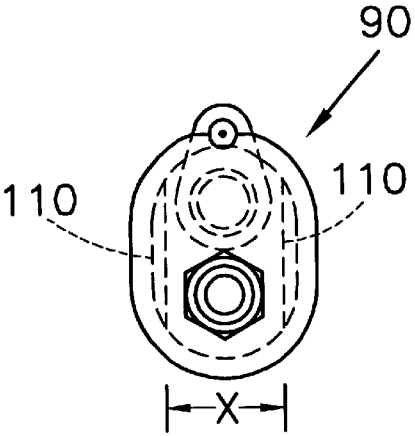
FIG. 12 is a rear elevational view of a connector of the invention with an igniter line passing therethrough.
Figure 15:
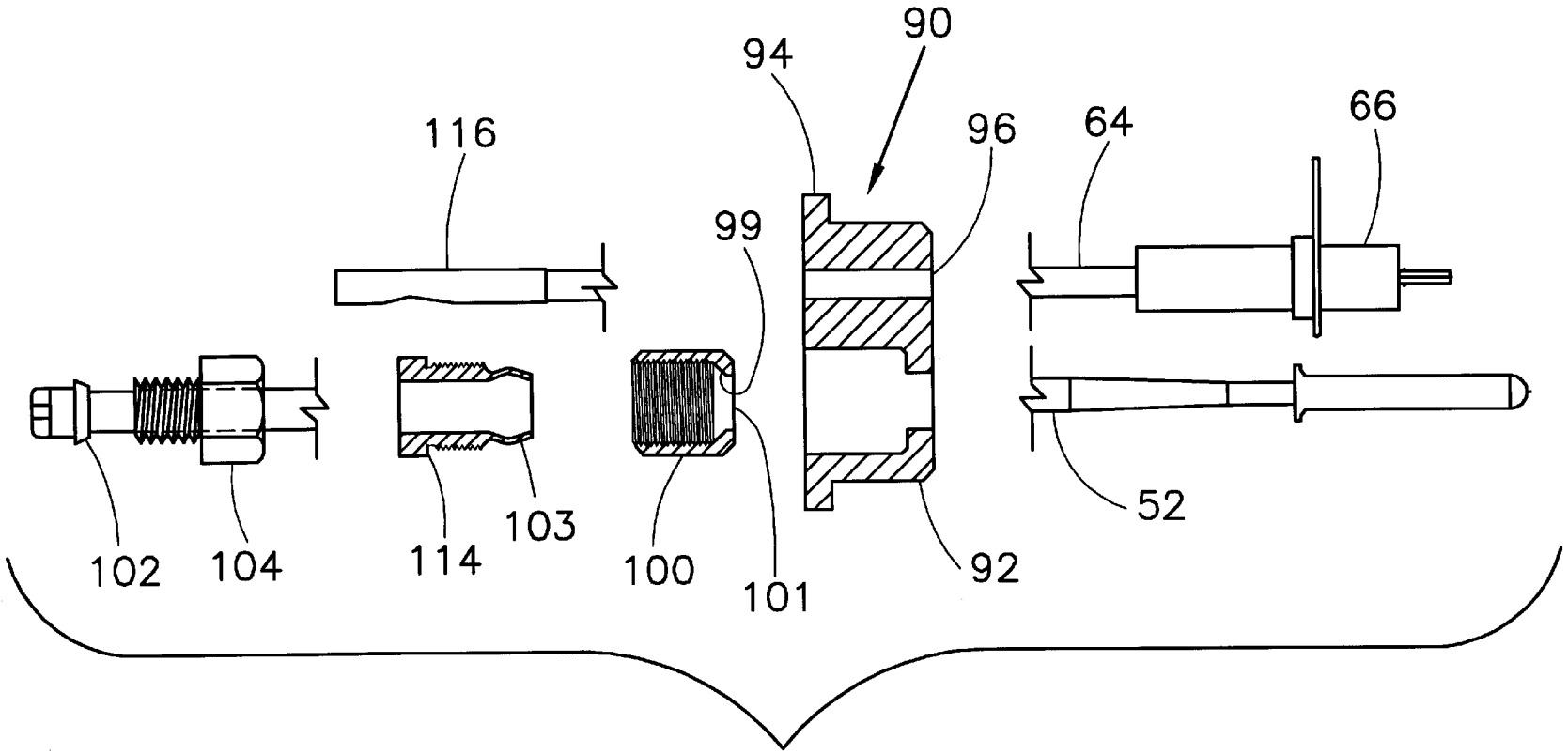
FIG. 15 shows a side sectional view of the connector shown in FIGS. 12–14 with accompanying lines and connection pieces, the connection pieces being taken partially in section.

As shown in FIGS. 14 and 16–17, a substantially U-shaped clip 106 engages a pair of grooves 108 on opposed sides of connector 90. The inner edges 108 of clip 106 are separated by distance X as shown in FIG. 16. That distance is substantially the same as distance X between the innermost edges 110 of grooves 108 on connector 90. The thickness of clip 106 is specifically set so that its thickness plus the thickness of plate 25 is thicker than the width Y of grooves 108 as shown in FIG. 14. This causes inner surface 112 of flange 94 to sealingly engage the outer surface of plate 25, thereby sealing connector 90 into place.

Pilot flame establishment can be achieved by Piezoelectric igniter 66. It connects to igniter line 64 which is also sealed to connector 90. This is achieved with a heat shrinkable tube 116 that is sized and shaped to closely fit over igniter line 64. Tube 116 and sheath 52 pass into opening 96 whereat heat is applied and tube 116 heat deforms to seal sheath 52 within opening 96. However, tube 116 should be made from a material that will not degrade up to at least about 500° F. Pilot flame observation window 23 is sealed to plate 25. Window 23 is preferably a "snap" in or friction fit window that is substantially sealed. Alternatively, pilot burner 49 may be lit by removing or opening access door 33. In such a case, safety interlocks (not illustrated) are included to ensure complete closure against unprotected fume access during water heater operation.

During normal operation, water heater 2 operates in the same fashion as conventional heaters.

Although this invention has been described in connection with specific forms thereof, it will be appreciated that a wide variety of equivalents may be substituted for the specified elements described herein without departing from the spirit and scope of this invention as described in the appended claims. For example, water tank 6 may be of any number of sizes and shapes and may be made from a wide variety of materials such as metals and/or plastics. Foam insulation 8 may similarly be made from any number of foam insulations well known in the art.

Jacket 4 is preferably made from coated steel, although galvanized steel or other materials such as plastic may be employed. Similarly, cover pan 5 and bottom pan 26 may be made from coated steel, plastics or the like. Burner 14 may be operated with a wide variety of fuels, including natural gas, propane, liquified natural gas, oil and the like.

What is claimed is:

1. An assembly for a water heater comprising:

a main burner fuel supply line adapted to connect between a fuel control valve and a main burner;

a pilot fuel supply line adapted to connect between said fuel control valve and a pilot burner; and a sealed one-piece plate through which said main burner fuel supply line and said pilot fuel supply line pass in a sealed condition, said plate adapted to engage and seal an outer surface of a side portion of a combustion chamber of said water heater along an entire perimeter of an opening defined therein to prevent extraneous fumes from entering the combustion chamber.

2. The assembly defined in claim 1 further comprising a heat resistant seal fixed to a surface of said plate and adapted to sealingly engage said side portion.

3. The assembly defined in claim 1 further comprising a heat sensor line connected to a heat sensor adapted to connect to said fuel control valve and positioned to sense heat from said pilot burner, said heat sensor passing through said plate in a sealed condition.

4. The assembly defined in claim 1 wherein said main burner is removably connectable to said main burner fuel supply line.

5. The assembly defined in claim 1 further comprising a glass window in said plate.

6. The assembly defined in claim 5 wherein said glass window removably friction fits into an opening in said plate.

7. The assembly defined in claim 1 wherein said main burner fuel supply line is sealed to said plate by swaging.

8. The assembly defined in claim 1 wherein said pilot fuel supply line is sealed to said plate by swaging.

9. The assembly defined in claim 1 further comprising an igniter line connected to an igniter positioned proximate said pilot burner and connected to an igniter initiator, said igniter line passing through said plate in a sealed condition.

10. The assembly defined in claim 9 wherein said igniter line is sealed to said plate with a heat shrunk wrapping material.

11. The assembly defined in claim 1 wherein said plate is removably attachable to a side wall of a combustion chamber of said water heater.

12. An assembly for a water heater comprising:

a main burner fuel supply line adapted to connect between a fuel control valve and a main burner:

a pilot fuel supply line adapted to connect between said fuel control valve and a pilot burner:

a plate through which said main burner fuel supply line and said pilot fuel supply line pass in a sealed condition, said plate adapted to sealingly engage a side portion of a combustion chamber of said water heater;

a heat sensor line connected to a heat sensor adapted to connect to said fuel control valve and positioned to sense heat from said pilot burner, said heat sensor passing through said plate in a sealed condition, wherein said heat sensor line is sealed to said plate with a seal connector, said seal connector comprising:

a seal base sized and shaped to closely fit through an opening in said plate and having a flange extending outwardly therefrom to sealingly engage a portion of a surface of said plate, said seal base having an opening extending therethrough, at least a portion of which is sized such that said heat sensor line is capable of extending therethrough;

a compression nut being sized and shaped to closely fit within said opening in said seal base and having a central opening extending therethrough sized and shaped to receive said heat sensor line, said central opening having a seal seat;

a compression ferrule sized and shaped on an inner surface of an opening extending therethrough to closely fit around said heat sensor line and on its outer surface to closely fit within said opening in said compression nut, and having a seal surface to sealingly engage said seal seat; and a substantially U-shaped clip having a pair of legs oriented to engage a pair of grooves extending along side portions of said seal base adjacent said flange, said legs having a thickness that, when added to the thickness of said plate, is larger than the width of said grooves such that when said seal base is positioned in said opening in said plate and said legs are positioned in said grooves, said flange forcibly sealingly engages said surface of said plate.

13. The assembly defined in claim 11 wherein said seal connector further comprises a tapered wire lock positioned in another opening in said seal base sized to receive said igniter line, said tapered wire lock being formed from a heat shrinkable material having a central opening sized to receive said heat shrinkable material, said heat shrinkable material being heat shrunk within said another opening and around a portion of said igniter line to thereby substantially seal said igniter line to said seal base.

14. An assembly for a water heater comprising:

a main burner fuel supply line adapted to connect between a fuel control valve and a main burner;

a pilot fuel supply line adapted to connect between said fuel control valve and a pilot burner;

a heat sensor line connected to a heat sensor adapted to connect to said fuel control valve and positioned to sense heat from said pilot burner;

an igniter line connected to an igniter positioned proximate said pilot burner and connected to an igniter initiator; and a sealed one-piece plate through which said main burner fuel supply line and said pilot fuel supply line pass in a sealed condition, said plate adapted to engage and seal in an outer surface of a side portion of a combustion chamber of said water heater along an entire perimeter of an opening defined therein to prevent extraneous fumes from entering the combustion chamber.

15. Apparatus for sealing at least one line entering into a water heater combustion chamber comprising:

a seal base sized and shaped to closely fit through an opening in a wall portion of combustion chamber said and having a flange extending outwardly therefrom to sealingly engage a surface of said wall portion, said seal base having an opening extending therethrough, at least a portion of which is sized such that said line is capable of extending therethrough;

a compression nut being sized and shaped to closely fit within said opening in said seal base and having a central opening extending therethrough sized and shaped to receive said line, said central opening having a seal seat;

a compression ferrule sized and shaped on an inner surface of an opening extending therethrough to closely fit around said line and on its outer surface to closely fit within said opening in said compression nut, and having a seal surface to sealingly engage said seal seat; and a substantially U-shaped clip having a pair of legs oriented to engage a pair of grooves extending along side portions of said seal base adjacent said flange, said legs having a thickness that, when added to the thickness of said wall portion, is larger than the width of said grooves such that when said seal base is positioned in said opening in said wall portion and said legs are positioned in said grooves, said flange forcibly sealingly engages said surface of said wall portion.

16. The apparatus defined in claim 15 further comprising a tapered wire lock positioned in another opening in said seal base sized to receive said another line, said tapered wire lock being formed from a heat shrinkable material having a central opening sized to receive said heat shrinkable material, said heat shrinkable material being heat shrunk within said another opening and around a portion of said another line to thereby substantially seal said another line to said seal base.

17. The apparatus defined in claim 16 wherein said wall portion is a removably attachable plate.

18. The water heater defined in claim 15 wherein said main burner fuel supply line is sealed to said plate by swaging.

19. The water heater defined in claim 15 wherein said pilot fuel supply line is sealed to said plate by swaging.

20. The water heater defined in claim 15 wherein said igniter line is sealed to said plate with a heat shrunk wrapping material.

21. A water heater comprising:

a water container;

a combustion chamber containing a main burner and a pilot burner positioned to heat water in said water container and having an opening through which combustion air passes and a side wall;

a main burner fuel supply line adapted to connect between a fuel control valve and a main burner;

a pilot fuel supply line adapted to connect between said fuel control valve and a pilot burner;

a heat sensor line connected to a heat sensor and adapted to connect to said fuel control valve and positioned to sense heat from said pilot burner;

an igniter line connected to an igniter positioned proximate said pilot burner and connected to an igniter initiator; and a removable sealed one-piece plate through which said main burner fuel supply line, said pilot fuel supply line, said heat sensor line and said igniter line pass in a sealed condition, said plate adapted to engage and seal said opening in an outer surface of said side wall along an entire perimeter of said opening to prevent extraneous fumes from entering the combustion chamber.

22. The water heater defined in claim 21 further comprising a heat resistant seal fixed to a surface of said plate and adapted to sealingly engage said side wall.

23. The water heater defined in claim 21 wherein said main burner is removably connectable to said main burner fuel supply line.

24. The water heater defined in claim 21 further comprising a glass window in said plate.

25. The water heater defined in claim 24 wherein said glass window removably friction fits into an opening in said plate.

26. A water heater comprising:

a water container;

a combustion chamber containing a main burner and a pilot burner positioned to heat water in said water container and having a side wall;

a main burner fuel supply line adapted to connect between a fuel control valve and a main burner;

a pilot fuel supply line adapted to connect between said fuel control valve and a pilot burner;

a heat sensor line connected to a heat sensor and adapted to connect to said fuel control valve and positioned to sense heat from said pilot burner;

an igniter line connected to an igniter positioned proximate said pilot burner and connected to an igniter initiator; and a removable plate through which said main burner fuel supply line, said pilot fuel supply line, said heat sensor line and said igniter line pass in a sealed condition, said plate adapted to sealingly engage said side wall, wherein said heat sensor line is sealed to said plate with a seal connector, said seal connector comprising:

a seal base sized and shaped to closely fit through an opening in said plate and having a flange extending outwardly therefrom to sealingly engage a portion of a surface of said plate, said seal base having an opening extending therethrough, at least a portion of which is sized such that said heat sensor detection line is capable of extending therethrough;

a compression nut being sized and shaped to closely fit within said opening in said seal base and having a central opening extending therethrough sized and shaped to receive said heat sensor line, said central opening having a seal seat;

a compression ferrule sized and shaped on an inner surface of an opening extending therethrough to closely fit around said heat sensor line and on its outer surface to closely fit within said opening in said compression nut, and having a seal surface to sealingly engage said seal seat; and a substantially U-shaped clip having a pair of legs oriented to engage a pair of grooves extending along side portions of said seal base adjacent said flange, said legs having a thickness that, when added to the thickness of said plate, is larger than the width of said grooves such that when said seal base is positioned in said opening in said plate and said legs are positioned in said grooves, said flange forcibly sealingly engages said surface of said plate.

27. The water heater defined in claim 26 wherein said seal connector further comprises a tapered wire lock positioned in another opening in said seal base sized to receive said igniter line, said tapered wire lock being formed from a heat shrinkable material having a central opening sized to receive said heat shrinkable material, said heat shrinkable material being heat shrunk within said another opening and around a portion of said igniter line to thereby substantially seal said igniter line to said seal base.

28. A water heater comprising:

a water container;

a combustion chamber containing a main burner and a pilot burner positioned to heat water in said water container and having a side wall;

a main burner fuel supply line adapted to connect between a fuel control valve and a main burner;

a pilot fuel supply line adapted to connect between said fuel control valve and a pilot burner; and a sealed one-piece plate through which said main burner fuel supply line and said pilot fuel supply line, pass in a sealed condition, said plate adapted to engage and seal in an outer surface of said side wall along an entire perimeter of an opening defined therein to prevent extraneous fumes from entering the combustion chamber.

* * * * *